US009778609B2

(12) United States Patent
Sasami

(10) Patent No.: US 9,778,609 B2
(45) Date of Patent: Oct. 3, 2017

(54) IMAGE FORMING DEVICE, IMAGE FORMING SYSTEM, AND PROGRAM

(71) Applicant: Konica Minolta, Inc., Tokyo (JP)

(72) Inventor: Shingo Sasami, Hino (JP)

(73) Assignee: Konica Monolta, Inc., Tokyo (JP)

( * ) Notice: Subject to any disclaimer, the term of this patent is extended or adjusted under 35 U.S.C. 154(b) by 0 days.

(21) Appl. No.: 15/163,992

(22) Filed: May 25, 2016

(65) Prior Publication Data

US 2016/0357136 A1 Dec. 8, 2016

(30) Foreign Application Priority Data

Jun. 3, 2015 (JP) ..... 2015-112779

(51) Int. Cl.
*G03G 15/00* (2006.01)
*G03G 15/20* (2006.01)

(52) U.S. Cl.
CPC ..... *G03G 15/5016* (2013.01); *G03G 15/2039* (2013.01); *G03G 15/55* (2013.01); *G03G 15/652* (2013.01); *G03G 15/70* (2013.01)

(58) Field of Classification Search
CPC combination set(s) only.
See application file for complete search history.

(56) References Cited

U.S. PATENT DOCUMENTS 5,117,261 A * 5/1992 Sakai ..... G03G 15/0131 399/19
2004/0126166 A1* 7/2004 Miyake ..... G03G 15/703 400/74
2007/0223022 A1* 9/2007 Suzuki ..... B41J 3/4075 358/1.12
2013/0142526 A1* 6/2013 Numazu ..... G03G 21/1685 399/21

FOREIGN PATENT DOCUMENTS

JP 2006-062093 A 3/2006
JP 2007-041370 A 2/2007
JP 2010-102158 A 5/2010
JP 2015-055859 A 3/2015

* cited by examiner

*Primary Examiner* — Clayton E Laballe
*Assistant Examiner* — Jas Sanghera
(74) *Attorney, Agent, or Firm* — Baker & Hostetler LLP

(57) ABSTRACT

An image forming device includes: a paper feeding unit configured to feed continuous form paper; an image forming unit configured to form an image on the continuous form paper; a fixing unit configured to fix the image formed on the continuous form paper; a measuring unit configured to measure a temperature of the fixing unit; and a control unit configured to control an operation of each of the paper feeding unit, the image forming unit, and the fixing unit, wherein when detecting a trouble with which feeding of the continuous form paper is suspended, the control unit performs determination processing of determining whether to prompt a user to execute removal of a part of the continuous form paper, which part is influenced by heat from the fixing unit, according to the temperature of the fixing unit which temperature is measured by the measuring unit in the detection of the trouble.

12 Claims, 9 Drawing Sheets

FIG. 3

T1

| KIND OF PAPER | REFERENCE TEMPERATURE [°C] | HEAT TOLERANCE |
|---|---|---|
| PLAIN PAPER | 180 | HIGH |
| CARDBOARD | 200 | HIGH |
| FILM | 100 | LOW |

FIG. 8

T2

| KIND OF PAPER | REFERENCE INTEGRATED TEMPERATURE [°C] | HEAT TOLERANCE |
|---|---|---|
| PLAIN PAPER | 540 | HIGH |
| CARDBOARD | 800 | HIGH |
| FILM | 100 | LOW |

IMAGE FORMING DEVICE, IMAGE FORMING SYSTEM, AND PROGRAM

CROSS-REFERENCE TO RELATED APPLICATIONS

The application is entitled to and claims the benefit of Japanese Patent Application No. 2015-112779 filed on Jun. 3, 2015, the contents of which, including the description, claims, drawings, and abstract, are incorporated herein by reference in its entirety.

BACKGROUND OF THE INVENTION

Field of the Invention

The present invention relates to an image forming device, an image forming system, and a program.

Description of the Related Arts

In a related art, an image forming device that uses continuous form paper such as roll paper as a recording medium and that forms an image on the continuous form paper has been known (see, for example, JP 2007-41370 A and JP 2010-102158 A). In such an image forming device using continuous form paper, there is a case where a part of continuous form paper in a vicinity of a fixing unit is damaged by an influence of heat when feeding is suspended due to generation of a trouble or the like in the device during image forming processing. Thus, when the feeding is suspended due to generation of a trouble or the like in the device, a user cuts and removes the part of the continuous form paper in the vicinity of the fixing unit and sets the paper again with a part following the removed part at a head in the image forming device in order to resume image forming processing.

Here, when there is no influence of heat on continuous form paper, it is not necessary to perform cutting and removing of a part of the continuous form paper and to set the paper again. However, in a related art, when a trouble with which feeding of continuous form paper is suspended is generated during image forming processing, a user cannot grasp an influence of heat on the continuous form paper and always sets the continuous form paper again after cutting and removing a part thereof. Thus, there is a heavy work burden on the user.

SUMMARY OF THE INVENTION

The present invention has been made in view of the forgoing, and an object thereof is to provide an image forming device, an image forming system, and a program that can reduce a work burden on a user in a case where a trouble with which feeding is suspended is generated during image forming processing on continuous form paper.

To achieve the abovementioned object, according to an aspect, an image forming device reflecting one aspect of the present invention comprises: a paper feeding unit configured to feed continuous form paper; an image forming unit configured to form an image on the continuous form paper; a fixing unit configured to fix the image formed on the continuous form paper; a measuring unit configured to measure a temperature of the fixing unit; and a control unit configured to control an operation of each of the paper feeding unit, the image forming unit, and the fixing unit, wherein when detecting a trouble with which feeding of the continuous form paper is suspended, the control unit performs determination processing of determining whether to prompt a user to execute removal of a part of the continuous form paper, which part is influenced by heat from the fixing unit, according to the temperature of the fixing unit which temperature is measured by the measuring unit in the detection of the trouble.

To achieve the abovementioned object, according to an aspect, an image forming device reflecting one aspect of the present invention comprises: a paper feeding unit configured to feed continuous form paper; an image forming unit configured to form an image on the continuous form paper; a fixing unit configured to fix the image formed on the continuous form paper; a measuring unit configured to measure a temperature of the fixing unit; and a control unit configured to control an operation of each of the paper feeding unit, the image forming unit, and the fixing unit, wherein when detecting a trouble with which feeding of the continuous form paper is suspended, the control unit performs determination processing of determining whether to prompt a user to execute removal of a part of the continuous form paper, which part is influenced by heat from the fixing unit, according to an integrated value of the temperature of the fixing unit which temperature is measured by the measuring unit in and after the detection of the trouble.

To achieve the abovementioned object, according to an aspect, an image forming system reflecting one aspect of the present invention comprises: the image forming device; a feeding device configured to feed continuous form paper to the image forming device; and a winder device configured to wind the continuous form paper fed from the image forming device.

To achieve the abovementioned object, according to an aspect, a non-transitory recording medium storing a computer readable program reflecting one aspect of the present invention causes a computer of an image forming device, which includes a paper feeding unit configured to feed continuous form paper, an image forming unit configured to from an image on the continuous form paper, a fixing unit configured to fix the image formed on the continuous form paper, and a measuring unit configured to measure a temperature of the fixing unit, to function as a control unit configured to perform determination processing, when a trouble with which feeding of the continuous form paper is suspended is detected, of determining whether to prompt a user to execute removal of a part of the continuous form paper, which part is influenced by heat from the fixing unit, according to the temperature of the fixing unit which temperature is measured by the measuring unit in the detection of the trouble.

To achieve the abovementioned object, according to an aspect, a non-transitory recording medium storing a computer readable program reflecting one aspect of the present invention causes a computer of an image forming device, which includes a paper feeding unit configured to feed continuous form paper, an image forming unit configured to from an image on the continuous form paper, a fixing unit configured to fix the image formed on the continuous form paper, and a measuring unit configured to measure a temperature of the fixing unit, to function as a control unit configured to perform determination processing, when a trouble with which feeding of the continuous form paper is suspended is detected, of determining whether to prompt a user to execute removal of a part of the continuous form paper, which part is influenced by heat from the fixing unit, according to an integrated value of the temperature of the fixing unit which temperature is measured by the measuring unit in and after the detection of the trouble.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 is a table illustrating an example of a setting table necessary for execution of display control processing of a first embodiment;

FIG. 8 is a table illustrating an example of a setting table necessary for execution of display control processing of a second embodiment.

DETAILED DESCRIPTION OF THE EMBODIMENTS

First Embodiment

Hereinafter, a first embodiment of the present invention will be described with reference to the drawings. However, the scope of the invention is not limited to the illustrated examples.

First, a configuration of an image forming system in the present embodiment will be described.

Figure 1:
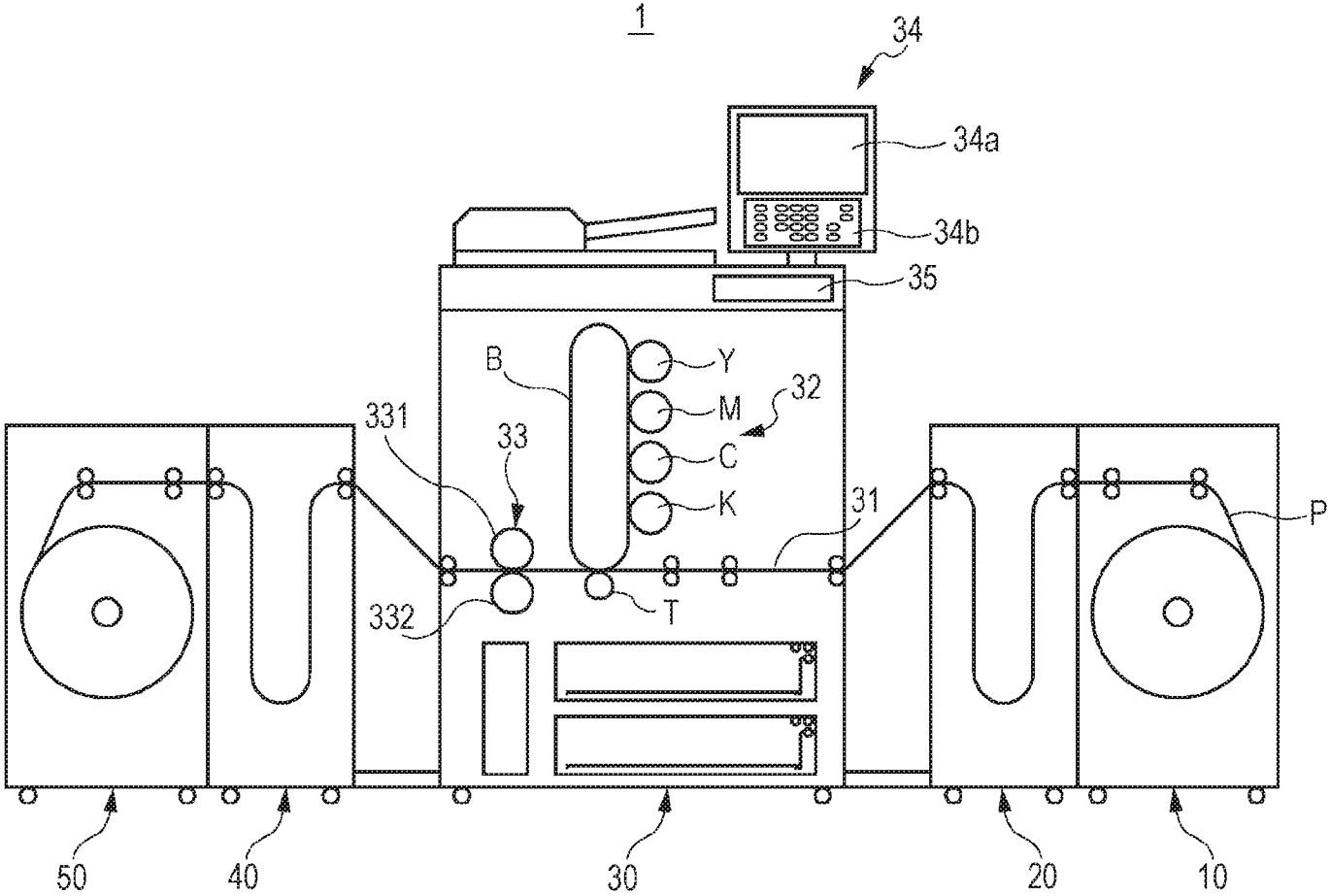
FIG. 1 is a view illustrating an example of a schematic configuration of an image forming system in an embodiment of the present invention.

FIG. 1 is a view illustrating an example of a schematic configuration of an image forming system 1.

The image forming system 1 is a system that uses continuous form paper (roll paper) P as a recording medium and that forms an image on the continuous form paper P. As illustrated in FIG. 1, the image forming system 1 includes a feeding device 10, a feeding adjustment device 20, an image forming device 30, a winding adjustment device 40, and a winder device 50 connected in this order from an upstream side in a feeding direction of the continuous form paper P.

The feeding device 10 is a device to feed the continuous form paper P to the image forming device 30. In a chassis of the feeding device 10, for example, as illustrated in FIG. 1, continuous form paper P having a roll shape is winded around a support shaft and is held rotatably. In the feeding device 10, the continuous form paper P winded around the support shaft is fed to the outside at a certain speed through a plurality of rollers (such as delivery roller and feeding roller). Note that the continuous form paper P is not necessarily held in a roll shape and may be held in a folded manner in the feeding device 10. Further, in FIG. 1, only one roll of continuous form paper P is illustrated. However, a plurality of rolls of continuous form paper may be held.

In the feeding direction of the continuous form paper P, the feeding adjustment device 20 is provided on a downstream side of the feeding device 10 and on an upstream side of the image forming device 30. The feeding adjustment device 20 is a device of feeding the continuous form paper P, which is fed from the feeding device 10, to the image forming device 30. The feeding adjustment device 20 holds the continuous form paper P in a slack manner as illustrated in FIG. 1 in order to absorb a difference between a speed of feeding the continuous form paper P in the feeding device 10 and a speed of feeding the continuous form paper P in the image forming device 30 and adjusts feeding of the continuous form paper P to the image forming device 30.

The image forming device 30 is a device including a printing function to form an image on the continuous form paper P. The image forming device 30 is provided on a downstream side of the feeding adjustment device 20 and on an upstream side of the winding adjustment device 40 in the feeding direction of the continuous form paper P.

The winding adjustment device 40 is provided on a downstream side of the image forming device 30 and on an upstream side of the winder device 50 in the feeding direction of the continuous form paper P. The winding adjustment device 40 is a device of feeding the continuous form paper P, which is fed from the image forming device 30, to the winder device 50. The winding adjustment device 40 holds the continuous form paper P in a slack manner as illustrated in FIG. 1 in order to absorb a difference between a speed of feeding the continuous form paper P in the image forming device 30 and a speed of feeding the continuous form paper P in the winder device 50 and adjusts ejection of the continuous form paper P from the image forming device 30.

The winder device 50 is a device of winding the continuous form paper P fed from the image forming device 30 through the winding adjustment device 40. In a chassis of the winder device 50, for example, as illustrated in FIG. 1, the continuous form paper P is winded around a support shaft and is held in a roll shape. Thus, in the winder device 50, the continuous form paper P fed from the winding adjustment device 40 is winded by the support shaft at a certain speed through a plurality of rollers (such as delivery roller and ejection roller). Note that in the winder device 50, the continuous form paper P is not necessarily held in a roll shape and may be cut for each page.

Figure 2:
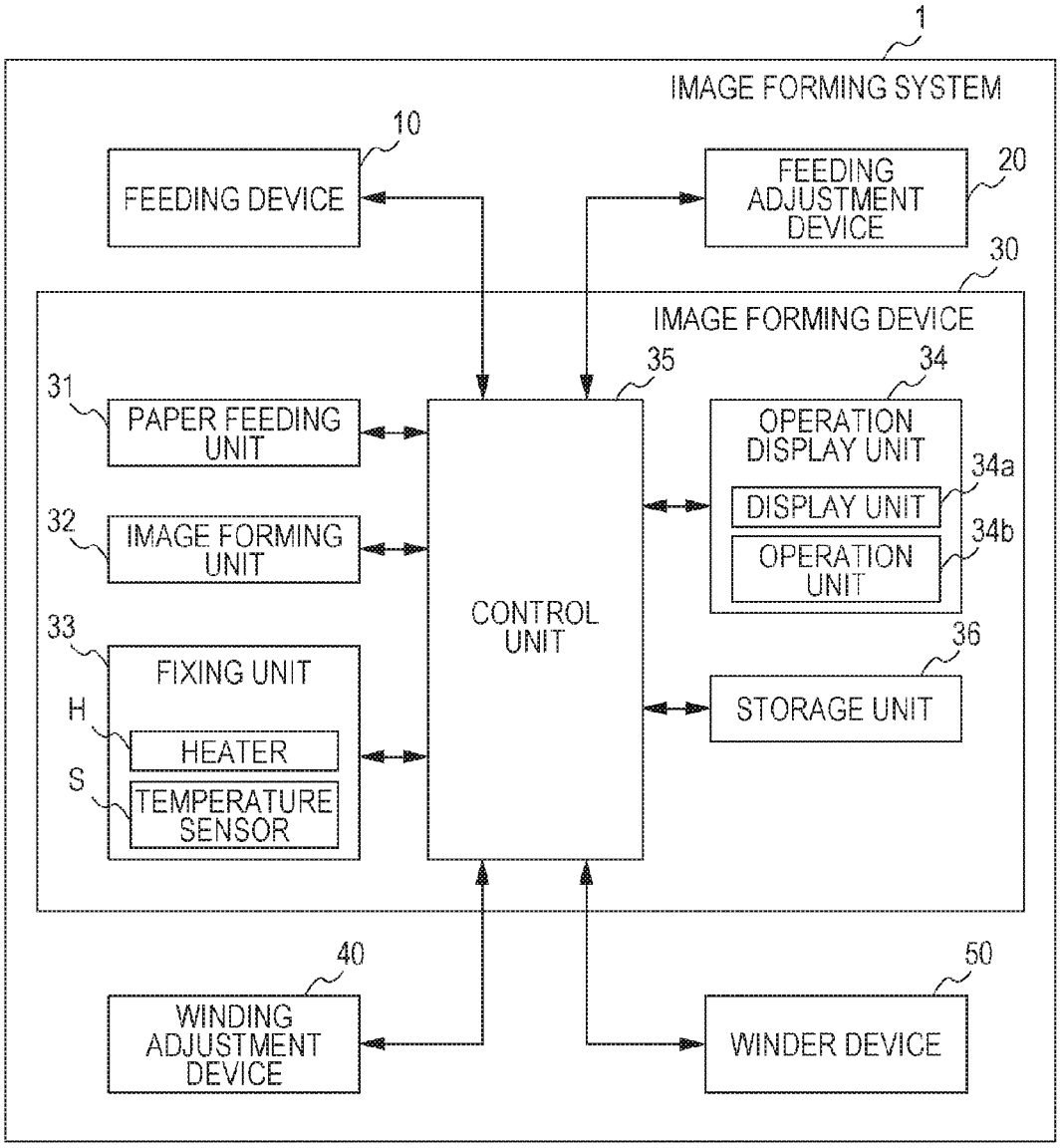
FIG. 2 is a functional block diagram illustrating a control configuration of an image forming device in an embodiment of the present invention.

Next, a configuration of the image forming device 30 will be described in detail. FIG. 2 is a functional block diagram illustrating a control configuration of the image forming device 30.

As illustrated in FIG. 2, the image forming device 30 includes, for example, a paper feeding unit 31, an image forming unit 32, a fixing unit 33, an operation display unit 34, a control unit 35, and a storage unit 36.

The paper feeding unit 31 is a mechanism of feeding the continuous form paper P in an inner part of the image forming device 30. For example, with a plurality of rollers, the paper feeding unit 31 feeds the continuous form paper P, which is fed from the feeding adjustment device 20, to the image forming unit 32 and feeds the continuous form paper P that passes through the image forming unit 32 and the fixing unit 33 to the winding adjustment device 40.

The image forming unit 32 forms a toner image by an electrophotography process and transfers the image to the continuous form paper P. For example, in the image forming unit 32, photoreceptor drums (Y, M, C, and K) and an intermediate transfer belt B are used as image carriers (see FIG. 1). The intermediate transfer belt B is an endless belt. The intermediate transfer belt B is winded by a plurality of rollers and is held in a travelable manner. Toner images in colors respectively formed on the photoreceptor drums (Y, M, C, and K) are serially transferred onto the intermediate transfer belt B and a toner image (color image) in which layers of colors (Y, M, C, and K) are superimposed is formed on the intermediate transfer belt B. Then, a bias having a reverse polarity of the toner is applied to a transfer roller T. Accordingly, the toner image formed on the intermediate transfer belt B is transferred onto the continuous form paper P.

The fixing unit 33 fixes the toner image transferred onto the continuous form paper P. For example, the fixing unit 33 includes a pair of rollers including a heating roller 331 and a pressing roller 332 to hold the continuous form paper P therebetween (see FIG. 1). The heating roller 331 is heated to a predetermined temperature by a heater H that is a heating source. The pressing roller 332 is biased by an elastic member (not illustrated) toward the heating roller 331. The continuous form paper P to which the toner image is transferred passes through a nip part between the heating roller 331 and the pressing roller 332 and heat and pressure is applied thereto, whereby the toner image is melted and fixed. Further, in a vicinity of an outer peripheral surface of the pressing roller 332, a temperature sensor (measuring unit) S is provided. A temperature of the vicinity of the outer peripheral surface of the pressing roller 332 can be measured as a temperature of the fixing unit 33.

The operation display unit 34 includes a display screen. On the screen, a display unit 34*a* to display various kinds of information and an operation unit 34*b* used by a user to input various instructions are included.

The control unit 35 includes, for example, a central processing unit (CPU), a random access memory (RAM), and the like. The CPU of the control unit 35 reads various programs such as a system program and a processing program stored in the storage unit 36, expands the programs in the RAM, and executes various kinds of processing according to the expanded programs. For example, the control unit 35 controls each unit included in the image forming device 30 and executes processing of forming an image on the continuous form paper P (image forming processing). Further, when a trouble in which feeding of the continuous form paper P is suspended is generated during the image forming processing, the control unit 35 executes display control processing to display, on the display unit 34*a*, a message prompting a user to make an appropriate action corresponding to a temperature of the fixing unit 33. A detail of the display control processing will be described later.

The storage unit 36 includes, for example, a hard disk drive (HDD) or a non-volatile semiconductor memory. The storage unit 36 stores various programs including the system program and the processing program executed by the control unit 35 and data necessary for execution of these programs. For example, the storage unit 36 stores setting information necessary for execution of the display control processing.

FIG. 3 is a table illustrating an example of a setting table T1 that is setting information necessary for execution of the display control processing. As illustrated in FIG. 3, in the setting table T1, a kind of continuous form paper P (kind of paper), and a reference temperature and heat tolerance corresponding thereto are set. Here, the reference temperature is a temperature to be a reference for determination of a message to be displayed on the display unit 34*a* in the display control processing. Further, the heat tolerance is setting indicating a degree of heat resistance of the paper. For example, paper including resin as a main material (that is, including resin for 50% or more) is set as "low." The paper including resin as a main material is, for example, synthetic paper of polyethylene, polypropylene, polyethylene terephthalate, polyvinyl chloride, or yupo (registered trademark). In the example of FIG. 3, three kinds of continuous form paper which are plain paper, cardboard, and a film are set as the kinds of paper. Then, with respect to the plain paper, it is set that a reference temperature is 180° C. and heat tolerance is high. With respect to the cardboard, it is set that a reference temperature is 200° C. and heat tolerance is high. With respect to the film, it is set that a reference temperature is 100° C. and heat tolerance is low.

Note that in the present embodiment, as illustrated in FIG. 2, the control unit 35 integrally controls the whole image forming system 1. However, each of the feeding device 10, the feeding adjustment device 20, the winding adjustment device 40, and the winder device 50 may include a control unit.

Further, the image forming device 30 may be a multi-function peripheral (MFP) including a copying function, a scanning function, and a facsimile function in addition to a printing function.

Next, an operation of the image forming system 1 in the present embodiment will be described. In the image forming system 1, image forming processing is executed with respect to the continuous form paper P. Then, when a trouble is generated in the image forming system 1 during the image forming processing and feeding of the continuous form paper P is suspended, the following display control processing of displaying a message, which prompts a user to make an appropriate action, on the display unit 34*a* of the operation display unit 34 is executed in the image forming system 1.

Figure 4:
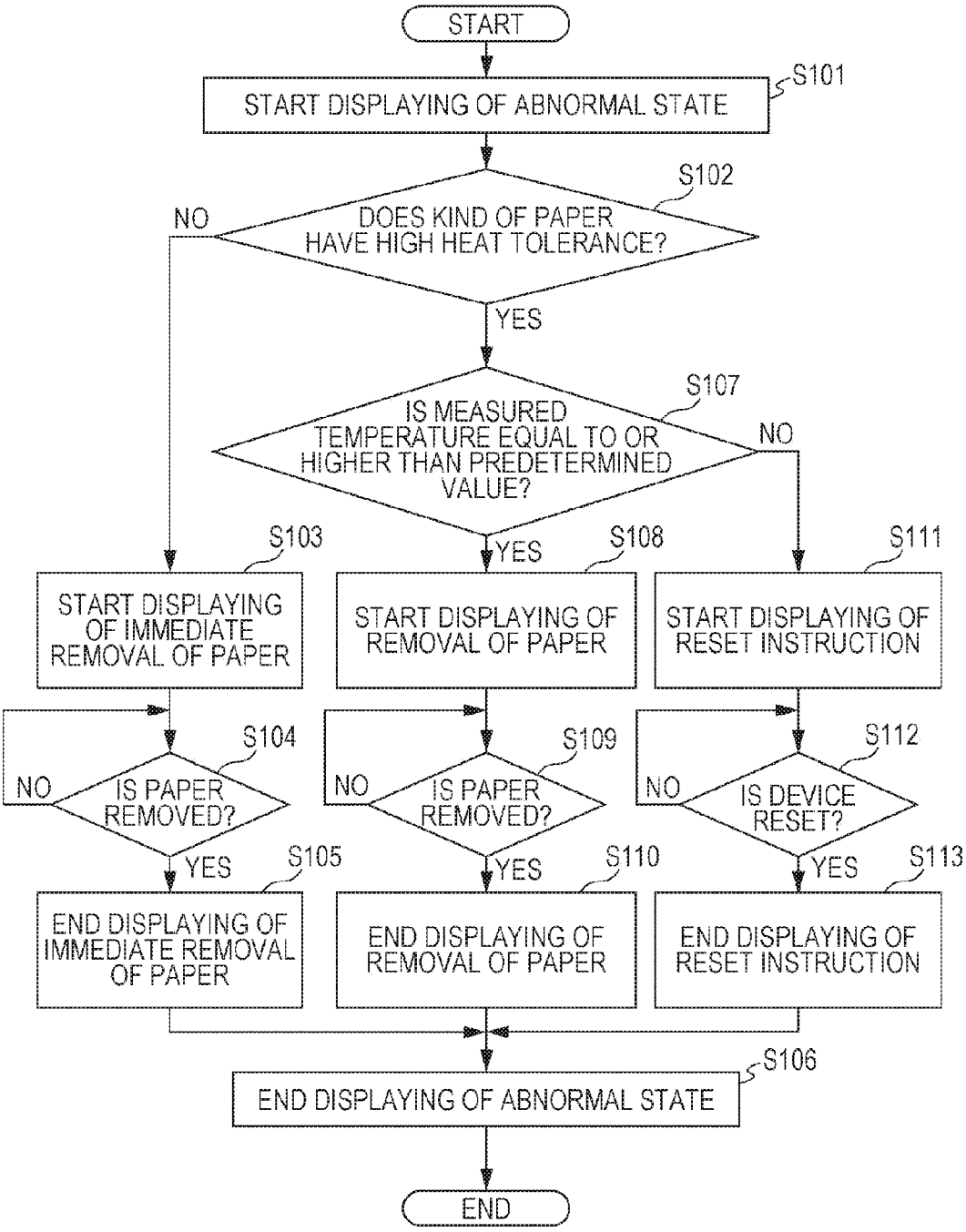
FIG. 4 is a flowchart illustrating a procedure of the display control processing of the first embodiment.

FIG. 4 is a flowchart illustrating a procedure of the display control processing. Note that FIG. 4 is a control flow in and after the suspension of the feeding of the continuous form paper P in the image forming system 1.

First, the control unit 35 starts displaying a display notifying generation of an abnormal state (display of abnormal state) on the display unit 34*a* of the operation display unit 34 (step S101).

Figure 5:
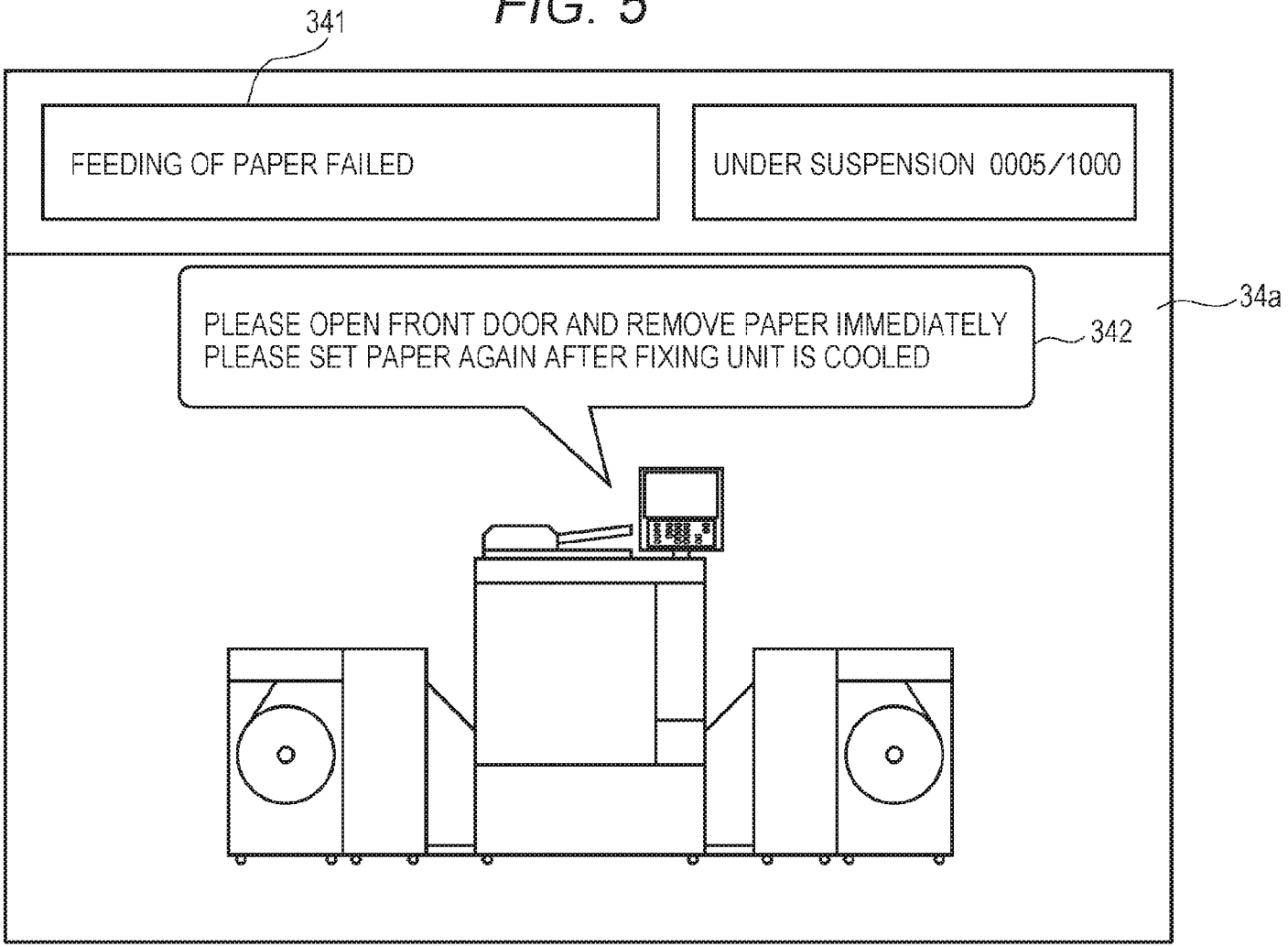
FIG. 5 is a view illustrating an example of a display unit with a display prompting immediate removal of paper.

FIG. 5 is a view illustrating an example of a display, which notifies generation of an abnormal state, on the display unit 34*a* of the operation display unit 34. When a trouble is generated in the image forming system 1 and feeding of the continuous form paper P is suspended, a message 341 such as "Feeding of paper failed" illustrated in FIG. 5 is displayed on the display unit 34*a* as a display notifying the generation of the abnormal state.

Referring back to FIG. 4, the control unit 35 then refers to the setting table T1 stored in the storage unit 36 and determines whether the continuous form paper P on which an image is currently formed is a kind of paper having high heat tolerance (step S102). When determining that the continuous form paper P is not the kind of paper having high heat tolerance (step S102: NO), the control unit 35 starts displaying, on the display unit 34*a* of the operation display unit 34, a display prompting immediate removal of the continuous form paper P (display of immediate removal of paper) (step S103).

FIG. 5 is a view illustrating an example of displaying, on the display unit 34*a* of the operation display unit 34, a display prompting immediate removal of the continuous form paper P along with the above-described display notifying generation of the abnormal state. The "display prompting immediate removal of continuous form paper P" means a display of a message prompting a user to immediately perform removal of a part of the continuous form paper P which part is influenced by heat from the fixing unit 33. In an embodiment of the present invention, the "part of continuous form paper P which part is influenced by heat from a fixing unit 33" corresponds to a part of the continuous form paper P which part is placed from an entrance to an exit of a fixing unit or a part of the continuous form paper P which part is in about front and rear 10 cm of a part in contact with a fixing roller. In FIG. 5, for example, a message 342 indicating "Please open a front door and remove paper immediately. Please set paper again after a fixing unit is cooled." is displayed.

When such a "display prompting immediate removal of continuous form paper P" is displayed on the display unit 34*a*, it is necessary to remove a part of the continuous form paper P which part is influenced by the heat from the fixing unit 33 in order to resolve the abnormal state. Further, in terms of controlling damage on the continuous form paper P, a response is preferably performed immediately. Thus, according to the display, a user immediately removes the part of the continuous form paper P, which part is influenced by the heat from the fixing unit 33, and sets the continuous form paper P again after the fixing unit 33 is cooled. More specifically, a user cuts the continuous form paper P on front and rear sides in the feeding direction of the image forming device 30 and removes the cut part from the paper feeding unit 31 of the image forming device 30. Then, after the fixing unit 33 is cooled, the continuous form paper P is made to pass through the paper feeding unit 31 of the image forming device 30 with a part, which follows the removed part, at a head. Then, the paper is attached to a part before the removed part and is set again. Accordingly, it is possible to deal with an abnormal state while controlling damage on the continuous form paper P due to heat as small as possible during generation of a trouble.

Referring back to FIG. 4, the control unit 35 then determines whether the continuous form paper P in the image forming system 1 is removed (step S104). When the continuous form paper P is not removed (step S104: NO), the processing in step S104 is repeatedly performed. On the other hand, when the continuous form paper P is removed (step S104: YES), the control unit 35 ends a display, which prompts immediate removal of the continuous form paper P, on the operation display unit 34 (step S105).

Then, the control unit 35 ends the display, which notifies generation of the abnormal state, on the operation display unit 34 (step S106) and ends the processing.

Further, when it is determined in step S102 that the continuous form paper P on which an image is currently formed is a kind of paper having high heat tolerance (step S102: YES), the control unit 35 measures a temperature of the fixing unit 33 with the temperature sensor S, refers to the setting table T1 stored in the storage unit 36, and determines whether the measured temperature of the fixing unit 33 is equal to or higher than a predetermined value (reference temperature) (determination processing: step S107).

Then, when it is determined that the measured temperature of the fixing unit 33 is equal to or higher than the predetermined value (step S107: YES), the control unit 35 starts displaying a display prompting removal of the continuous form paper P (display of removal of paper) on the display unit 34*a* of the operation display unit 34 (step S108).

Figure 6:
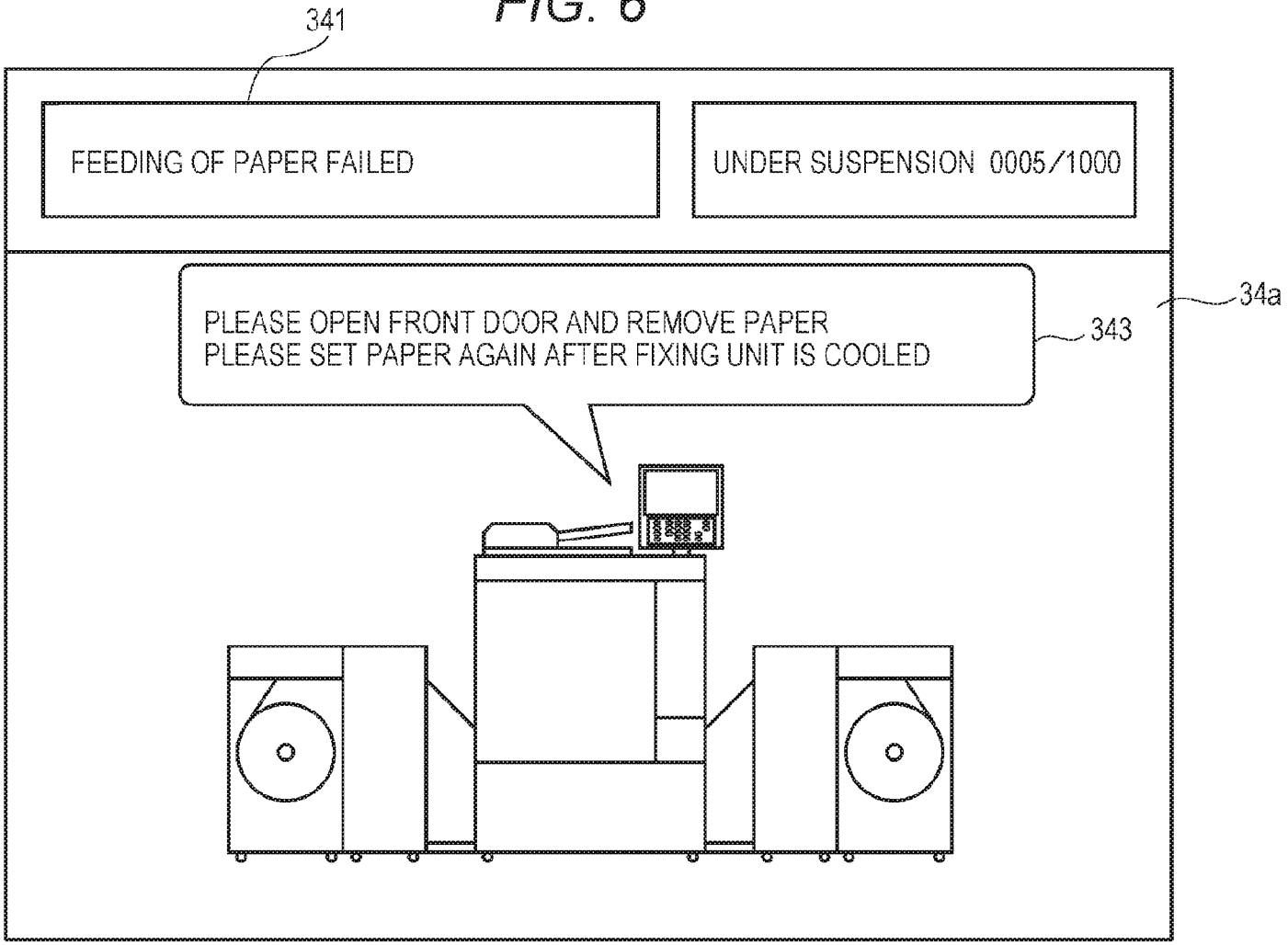
FIG. 6 is a view illustrating an example of a display unit with a display prompting removal of paper.

FIG. 6 is a view illustrating an example of displaying, on the display unit 34*a* of the operation display unit 34, a display prompting removal of the continuous form paper P along with the above-described display notifying generation of the abnormal state. The "display prompting removal of continuous form paper P" means a display of a message prompting a user to execute removal, which is not necessarily performed immediately, of a part of the continuous form paper P which part is influenced by heat from the fixing unit 33. In FIG. 6, for example, a message 343 indicating "Please open a front door and remove paper. Please set paper again after a fixing unit is cooled." is displayed.

When such a "display prompting removal of continuous form paper P" is displayed on the display unit 34*a*, it is necessary to remove a part of the continuous form paper P which part is influenced by the heat from the fixing unit 33 in order to resolve the abnormal state. Thus, according to the display, a user removes the part of the continuous form paper P, which part is influenced by the heat from the fixing unit 33, and sets the continuous form paper P again after the fixing unit 33 is cooled. Note that since the continuous form paper P has high heat tolerance, the continuous form paper P may be removed after the fixing unit 33 is cooled.

Referring back to FIG. 4, the control unit 35 then determines whether the continuous form paper P in the image forming system 1 is removed (step S109). When the continuous form paper P is not removed (step S109: NO), the processing in step S109 is repeatedly performed. On the other hand, when the continuous form paper P is removed (step S109: YES), the control unit 35 ends the display, which prompts removal of the continuous form paper P, on the operation display unit 34 (step S110) and the processing transitions to step S106 described above.

Further, in step S107, when it is determined that the measured temperature of the fixing unit 33 is lower than the predetermined value (step S107: NO), the control unit 35 starts displaying a reset instruction on the display unit 34*a* of the operation display unit 34 (step S111).

Figure 7:
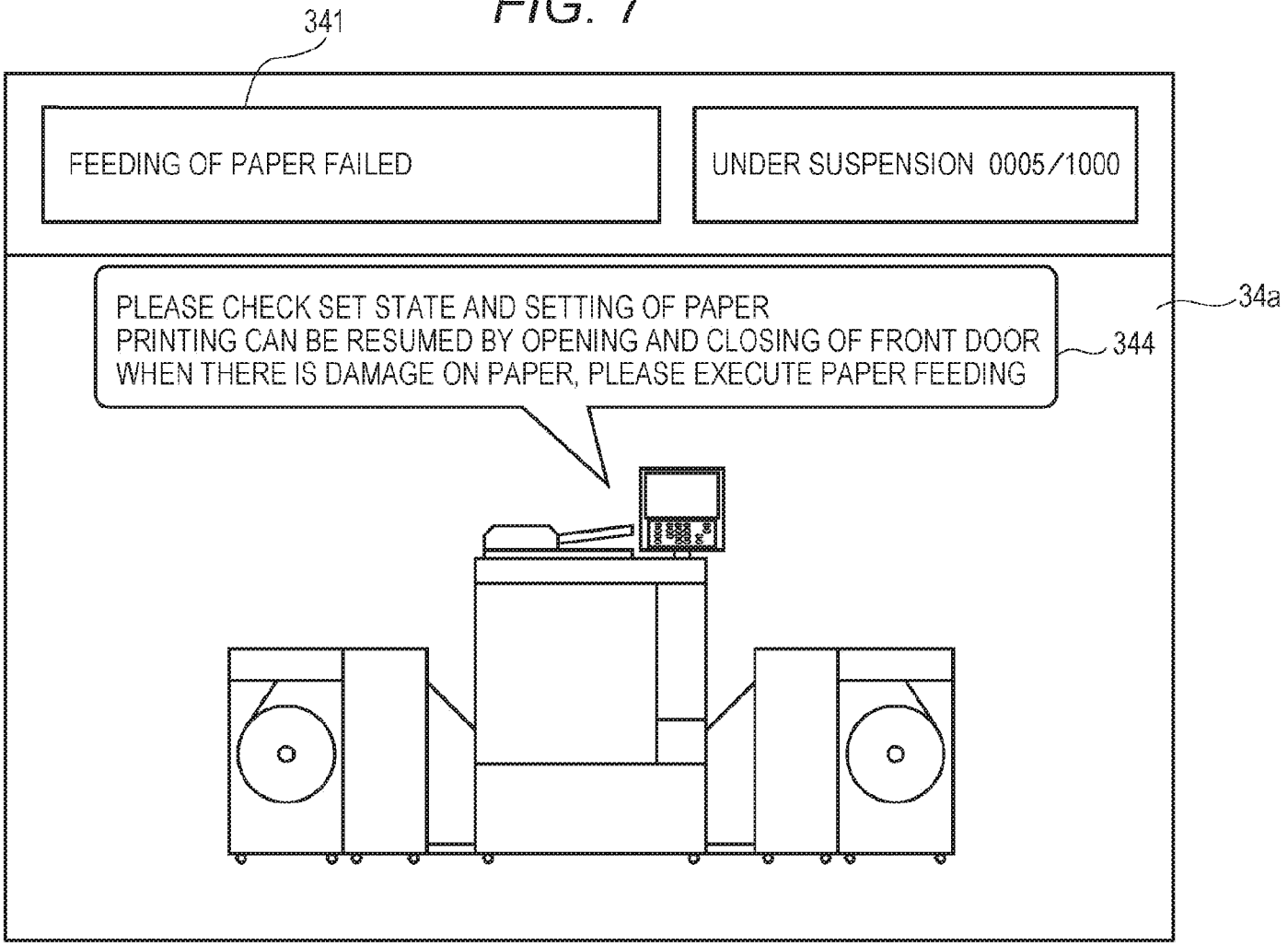
FIG. 7 is a view illustrating an example of a display unit displaying a reset instruction.

FIG. 7 is a view illustrating an example of displaying a reset instruction on the display unit 34*a* of the operation display unit 34 along with the above-described display notifying generation of the abnormal state. Here, the "display of a reset instruction" means a display of a message prompting a user to reset the image forming system 1. In FIG. 7, for example, a message 344 indicating "Please check a set state and setting of paper. Printing can be resumed by opening and closing of a front door. When there is damage on the paper, please execute paper feeding." is displayed.

When such a "display of a reset instruction" is displayed on the display unit 34*a*, it is not necessary to remove a part of the continuous form paper P, which part is influenced by the heat from the fixing unit 33, in resolving an abnormal state. Resetting of the device (such as temporarily turning off of power of image forming system 1 and reactivating power, or opening and closing front door of image forming device 30) is executed. Thus, a user resets the device according to the display. Accordingly, even when a trouble is generated, it is possible to recognize a case where removal of the continuous form paper P from an inner part of the device is not necessary. It is possible to reduce time and effort of a user dealing with the abnormal state.

Referring back to FIG. 4, the control unit 35 then determines whether the image forming system 1 is reset (step S112). When the system is not reset (step S112: NO), the processing in step S112 is repeatedly performed. On the other hand, when the image forming system 1 is reset (step S112: YES), the control unit 35 ends displaying of the reset instruction on the operation display unit 34 (step S113) and the processing transitions to step S106 described above.

As described above, according to the present embodiment, the paper feeding unit 31 to feed continuous form paper P, the image forming unit 32 to form an image on the continuous form paper P, the fixing unit 33 to fix the image formed on the continuous form paper P, the temperature sensor S to measure a temperature of the fixing unit 33, and the control unit 35 to control operations of the paper feeding unit 31, the image forming unit 32, and the fixing unit 33 are included. When a trouble with which feeding of the continuous form paper P is suspended is detected, according to the temperature of the fixing unit 33 measured by the temperature sensor S in the detection of the trouble, the control unit 35 performs determination processing to determine whether to prompt a user to execute removal of a part of the continuous form paper P which part is influenced by heat from the fixing unit 33. Thus, in a case where a trouble with which feeding of the continuous form paper P is suspended is detected, a user is prompted to execute removal of a part of the continuous form paper P, which part is influenced by heat from the fixing unit 33, only when the removal is necessary according to a temperature of the fixing unit 33. Thus, it is possible to reduce a burden on a user in a case where a trouble is generated in image forming processing on the continuous form paper P.

Further, according to the present embodiment, the control unit 35 determines to prompt a user to execute removal of a part of the continuous form paper P, which part is influenced by heat from the fixing unit 33, when a temperature of the fixing unit 33 in detection of a trouble is equal to or higher than a predetermined value and to prompt a user to reset the device when the temperature of the fixing unit 33 in the detection of the trouble is lower than the predetermined value. Thus, when a trouble with which feeding of the continuous form paper P is suspended is detected and in a case where a temperature of the fixing unit 33 is lower than the predetermined value, a user is prompted to perform resetting of a device instead of removal of the continuous form paper P. Thus, a user can recognize a case where the device is to be reset in order to resolve a trouble with which feeding of the continuous form paper P is suspended. It is possible to reduce a burden on the user in a case where a trouble is generated in image forming processing on the continuous form paper P.

Further, according to the present embodiment, when detecting a trouble with which feeding of the continuous form paper P is suspended, the control unit 35 determines whether to prompt a user to immediately execute removal of a part of the continuous form paper P, which part is influenced by heat from the fixing unit 33, according to a kind of the used continuous form paper P. Thus, it is possible to prompt a user to make an immediate response corresponding to a kind of used continuous form paper P.

Further, according to the present embodiment, when a main material of a kind of used continuous form paper P is resin, the control unit 35 determines to prompt user to immediately execute removal of a part of the continuous form paper P which part is influenced by heat from the fixing unit 33. Thus, when continuous form paper P has low heat tolerance, it is possible to prompt a user to make an immediate response.

Further, according to the present embodiment, the display unit 34*a* to display a predetermined message is included. The control unit 35 displays, on the display unit 34*a*, a message corresponding to a result of the determination processing (removal of continuous form paper P, immediate removal of continuous form paper P, or resetting of device). Accordingly, a user can recognize a necessary action from a message displayed on the display unit 34*a*.

Further, according to the present embodiment, when detecting a trouble with which feeding of continuous form paper P is suspended, the control unit 35 starts displaying, on the display unit 34*a*, a display notifying generation of an abnormal state and ends the display notifying generation of the abnormal state on the display unit 34*a* in a case where an action corresponding to a result of the determination processing is made. Thus, with a display on the display unit 34*a*, a user can recognize that an abnormal state is generated and that the abnormal state is resolved.

Second Embodiment

Next, a part of a second embodiment of the present invention which part is different from the first embodiment will be mainly described. Note that in the following description, to a configuration identical to that of the first embodiment, the same sign is assigned and a description thereof is omitted.

In the present embodiment, according to an integrated value of a temperature of a fixing unit 33 in and after detection of a trouble, a control unit 35 determines whether to prompt a user to execute removal of a part of continuous form paper P which part is influenced by heat from the fixing unit 33. More specifically, when detecting a trouble with which feeding of the continuous form paper P is suspended, the control unit 35 determines whether to display a "display of prompting immediate removal of continuous form paper P" on a display unit 34*a* according to a kind of the continuous form paper P similarly to the first embodiment. Then, when the continuous form paper P is a kind of paper having high heat tolerance, the control unit 35 integrates a temperature of the fixing unit 33 in each predetermined period (such as one minute) from the detection of the trouble. When the integrated value becomes equal to or larger than a predetermined value (reference integrated temperature), it is determined to prompt a user to execute removal of the part of the continuous form paper P, which part is influenced by the heat from the fixing unit 33, and a "display of prompting removal of continuous form paper P" is displayed on the display unit 34*a*.

FIG. 8 is a table illustrating an example of a setting table T2 used for execution of display control processing of the present embodiment. As illustrated in FIG. 8, in the setting table T2, a kind of continuous form paper P (kind of paper), and a reference integrated temperature and heat tolerance correspond thereto are set. In the example of FIG. 8, three kinds of continuous form paper which are plain paper, cardboard, and a film are set as the kinds of paper. Then, with respect to the plain paper, it is set that a reference integrated temperature is 540° C. and heat tolerance is high. With respect to the cardboard, it is set that a reference integrated temperature is 800° C. and heat tolerance is high. With respect to the film, it is set that a reference integrated temperature is 100° C. and heat tolerance is low.

Figure 9:
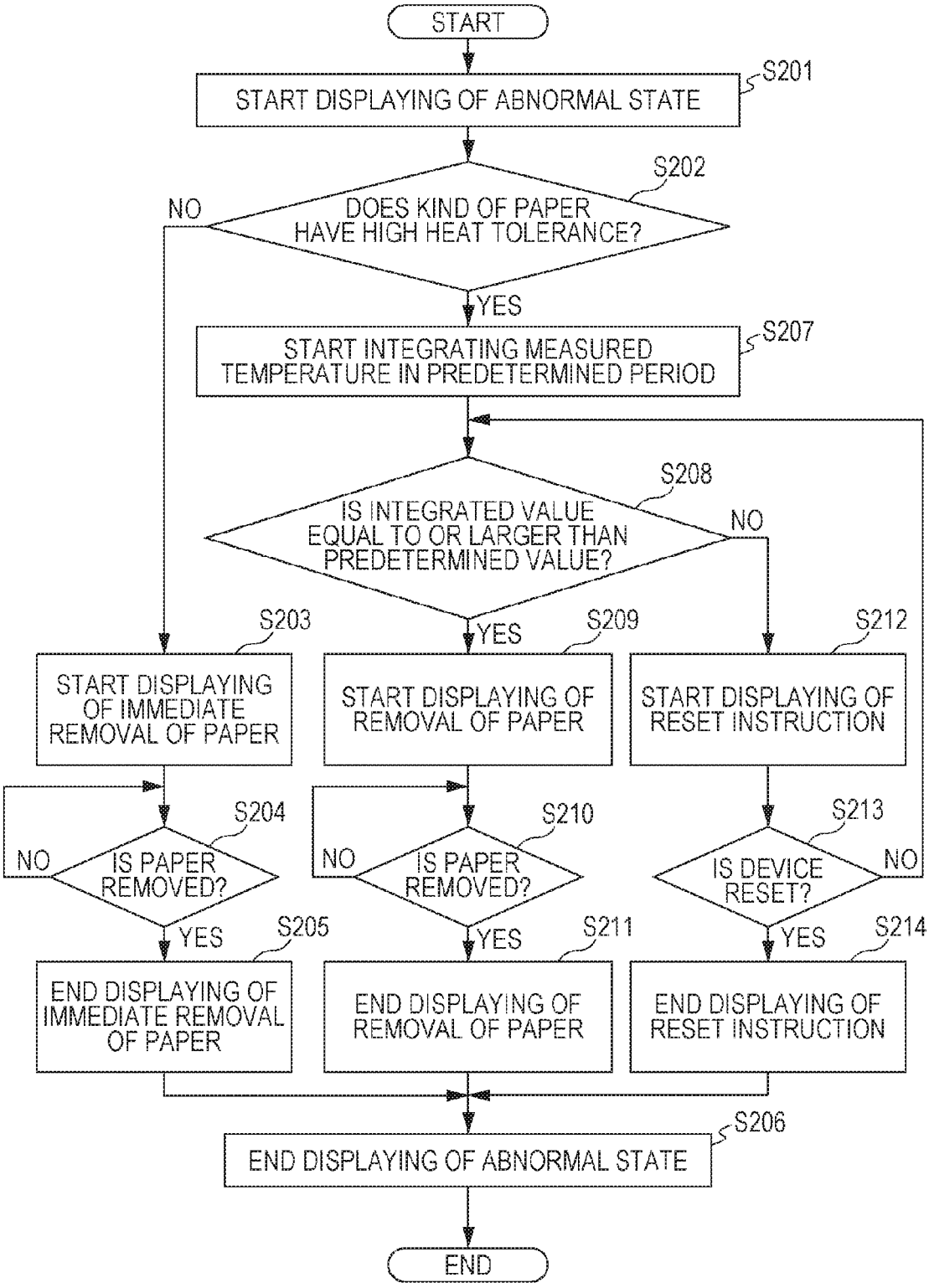
FIG. 9 is a flowchart illustrating a procedure of the display control processing of the second embodiment.

FIG. 9 is a flowchart illustrating a procedure of display control processing of the present embodiment. Similarly to FIG. 4, FIG. 9 is also a control flow in and after generation of a trouble and suspension of an operation in an image forming system 1 during image forming.

Since processing in step S201 to step S206 in FIG. 9 is identical to that in step S101 to step S106 in FIG. 4, a description thereof is omitted.

When it is determined in step S202 that continuous form paper P on which an image is currently formed is a kind of paper having high heat tolerance (step S202: YES), the control unit 35 starts integrating a measured temperature of the fixing unit 33 in a predetermined period (step S207).

Then, the control unit 35 refers to the setting table T2 stored in the storage unit 36 and determines whether the integrated value is equal to or larger than a predetermined value (reference integrated temperature) (step S208). When the integrated value is equal to or larger than the predetermined value (step S208: YES), the processing transitions to step S209. Further, when it is determined in step S208 that the integrated value is smaller than the predetermined value (step S208: NO), the processing transitions to step S212.

Since processing in step S209 to step S211 is identical to that in step S108 to step S110 in FIG. 4 and processing in step S212 to step S214 is identical to that in step S111 to step S113 in FIG. 3, a description thereof is omitted.

By the above processing, in a case where the fixing unit 33 is at a temperature lower than the predetermined value when a trouble is generated, a message 344 prompting a reset instruction for the device is displayed on the display unit 34*a*. However, when the abnormal state is neglected and an integrated value becomes equal to or larger than the predetermined value, a message is switched and a message 343 prompting removal of the continuous form paper P is displayed on the display unit 34*a*.

As described above, according to the present embodiment, the paper feeding unit 31 to feed continuous form paper P, the image forming unit 32 to form an image on the continuous form paper P, the fixing unit 33 to fix the image formed on the continuous form paper P, the temperature sensor S to measure a temperature of the fixing unit 33, and the control unit 35 to control operations of the paper feeding unit 31, the image forming unit 32, and the fixing unit 33 are included. When a trouble with which feeding of the continuous form paper P is suspended is detected, according to an integrated value of a temperature of the fixing unit 33 measured by the temperature sensor S in and after the detection of the trouble, the control unit 35 performs determination processing to determine whether to prompt a user to execute removal of a part of the continuous form paper P which part is influenced by heat from the fixing unit 33. Thus, in a case where a trouble with which feeding of the continuous form paper P is suspended is detected, a user is prompted to execute removal of a part of the continuous form paper P, which part is influenced by heat from the fixing unit 33, only when the removal is necessary according to an integrated value of a temperature of the fixing unit 33. Thus, it is possible to reduce burden on a user in a case where a trouble is generated in image forming processing on the continuous form paper P.

Further, according to the present embodiment, the control unit 35 determines to prompt a user to execute resetting of the device when an integrated value is smaller than a predetermined value. Then, the control unit 35 performs switching to a determination of prompting a user to execute removal of a part of the continuous form paper P, which part is influenced by heat from the fixing unit 33, when the integrated value becomes equal to or larger than the predetermined value. Thus, when a trouble with which feeding of continuous form paper P is suspended is detected and in a case where an integrated value of a temperature of the fixing unit 33 is smaller than a predetermined value, a user is prompted to perform resetting of the device instead of removal of the continuous form paper P. In a case where the integrated value becomes equal to or larger than the predetermined value, the user is prompted to execute removal of the continuous form paper P for the first time. Thus, a user can recognize a case where the device is to be reset in order to resolve a trouble with which feeding of the continuous form paper P is suspended. It is possible to reduce a burden on the user in a case where a trouble is generated in image forming processing on the continuous form paper P.

Note that in the above second embodiment, calculation of a period until an integrated value reaches a predetermined value may be performed along with calculation of the integrated value in step S207 and the period may be displayed along with a reset instruction in step S212. For example, with a display in a form of a countdown, a user can easily understand the display.

Further, in each of the above first and second embodiments, an example of a configuration in which a message is displayed on the display unit 34*a* in order to prompt a user to make a response has been described. However, a configuration in which sound or the like is used instead of the display to prompt a user to perform necessary processing may be included.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

a paper feeding unit feeding continuous form paper;

an image forming unit forming an image on the continuous form paper;

a fixing unit fixing the image formed on the continuous form paper;

a measuring unit measuring a temperature of the fixing unit; and a control unit controlling an operation of each of the paper feeding unit, the image forming unit, and the fixing unit, wherein when detecting a trouble with which feeding of the continuous form paper is suspended, the control unit performs determination processing of determining whether to prompt a user to execute removal of a part of the continuous form paper, which part is influenced by heat from the fixing unit, according to the temperature of the fixing unit which temperature is measured by the measuring unit in the detection of the trouble, further wherein the control unit determines:

to prompt a user to execute removal of the part of the continuous form paper, which part is influenced by the heat from the fixing unit, when the temperature of the fixing unit in the detection of the trouble is equal to or higher than a predetermined value and to prompt a user to execute resetting of the device when the temperature of the fixing unit in the detection of the trouble is lower than the predetermined value.

2. The image forming device according to claim 1, further comprising a display unit displaying a predetermined message, wherein the control unit displays, on the display unit, a message corresponding to a result of the determination processing.

3. The image forming device according to claim 2, wherein the control unit starts displaying, on the display unit, a display notifying generation of an abnormal state when the trouble with which feeding of the continuous form paper is suspended is detected, and ends the display notifying generation of the abnormal state on the display unit when an action corresponding to the result of the determination processing is made.

4. An image forming system comprising:

the image forming device according to claim 1;

a feeding device feeding continuous form paper to the image forming device; and a winder device winding the continuous form paper fed from the image forming device.

5. An image forming device comprising:

a paper feeding unit feeding continuous form paper;

an image forming unit forming an image on the continuous form paper;

a fixing unit fixing the image formed on the continuous form paper;

a measuring unit measuring a temperature of the fixing unit; and a control unit controlling an operation of each of the paper feeding unit, the image forming unit, and the fixing unit, wherein when detecting a trouble with which feeding of the continuous form paper is suspended, the control unit performs determination processing of determining whether to prompt a user to execute removal of a part of the continuous form paper, which part is influenced by heat from the fixing unit, according to an integrated value of the temperature of the fixing unit which temperature is measured by the measuring unit in and after the detection of the trouble.

6. The image forming device according to claim 5, wherein the control unit determines to prompt a user to execute resetting of the device when the integrated value is smaller than a predetermined value, and performs switching to a determination of prompting the user to execute removal of the part of the continuous form paper, which part is influenced by the heat from the fixing unit, when the integrated value becomes equal to or larger than the predetermined value.

7. The image forming device according to claim 5, wherein when detecting the trouble with which feeding of the continuous form paper is suspended, the control unit determines whether to prompt a user to immediately execute removal of the part of the continuous form paper, which part is influenced by the heat from the fixing unit, according to a kind of the used continuous form paper.

8. The image forming device according to claim 5, further comprising a display unit displaying a predetermined message, wherein the control unit displays, on the display unit, a message corresponding to a result of the determination processing.

9. An image forming system comprising:

the image forming device according to claim 5;

a feeding device configured to feed continuous form paper to the image forming device; and a winder device winding the continuous form paper fed from the image forming device.

10. An image forming device comprising:

a paper feeding unit feeding continuous form paper;

an image forming unit forming an image on the continuous form paper;

a fixing unit fixing the image formed on the continuous form paper;

a measuring unit measuring a temperature of the fixing unit; and a control unit controlling an operation of each of the paper feeding unit, the image forming unit, and the fixing unit, wherein when detecting a trouble with which feeding of the continuous form paper is suspended, the control unit performs determination processing of determining whether to prompt a user to execute removal of a part of the continuous form paper, which part is influenced by heat from the fixing unit, according to the temperature of the fixing unit which temperature is measured by the measuring unit in the detection of the trouble, further wherein when detecting the trouble with which feeding of the continuous form paper is suspended, the control unit determines whether to prompt a user to immediately execute removal of the part of the continuous form paper, which part is influenced by the heat from the fixing unit, according to a kind of the used continuous form paper.

11. The image forming device according to claim 10, wherein the control unit determines to prompt a user to immediately execute removal of the part of continuous form paper, which part is influenced by the heat from the fixing unit, when the kind of the used continuous form paper includes resin as a main material.

12. A non-transitory recording medium storing a computer readable program for causing a computer of an image forming device, which includes a paper feeding unit feeding continuous form paper, an image forming unit forming an image on the continuous form paper, a fixing unit fixing the image formed on the continuous form paper, and a measuring unit measuring a temperature of the fixing unit, to function as a control unit performing determination processing, when a trouble with which feeding of the continuous form paper is suspended is detected, of determining whether to prompt a user to execute removal of a part of the continuous form paper, which part is influenced by heat from the fixing unit, according to an integrated value of the temperature of the fixing unit which temperature is measured by the measuring unit in and after the detection of the trouble.

* * * * *